United States Patent [19]

Moreland

[11] Patent Number: 4,813,369

[45] Date of Patent: Mar. 21, 1989

[54] WARNING PENNANT

[76] Inventor: Brenda G. Moreland, 1604 Bentley Rd., Edgewater, Md. 21037

[21] Appl. No.: 111,519

[22] Filed: Oct. 21, 1987

[51] Int. Cl.[4] ..... B63C 9/20; G09F 17/00

[52] U.S. Cl. ..... 116/173; 24/442; 116/209; 441/68

[58] Field of Search ..... 116/173, 209; 2/DIG. 6; 24/306, 442; 441/89

[56] References Cited

U.S. PATENT DOCUMENTS

| | | | |
|---|---|---|---|
| 2,717,437 | 9/1955 | De Mestral | 28/72 |
| 3,057,354 | 10/1962 | Roberts et al. | 2/DIG. 6 |
| 3,183,883 | 5/1965 | Ruhlman et al. | 116/209 |
| 3,266,458 | 8/1966 | Ahlquist | 116/173 |
| 3,678,886 | 7/1972 | Tibbet | 116/173 |
| 3,785,337 | 1/1974 | Flowerday | 116/209 X |
| 3,788,269 | 1/1974 | Scarlet | 116/173 |
| 4,035,856 | 7/1977 | Oberg | 116/173 X |
| 4,177,750 | 12/1979 | Scarlet | 116/173 |
| 4,220,302 | 9/1980 | Hampton et al. | 24/306 |
| 4,259,957 | 4/1981 | Sonenstein | 2/DIG. 6 X |
| 4,418,733 | 12/1983 | Kallman | 116/209 X |
| 4,598,661 | 7/1986 | Roe | 116/173 X |
| 4,706,914 | 11/1987 | Ground | 24/447 X |

*Primary Examiner*—Daniel M. Yasich

*Attorney, Agent, or Firm*—Mason, Fenwick & Lawrence

[57] ABSTRACT

An elongated pennant-like member formed of a flexible sheet has a banner portion and a base portion; a connector pile panel extends transversely of the base portion and a connector hook panel extends transversely across the base portion in spaced relation to the pile panel for permitting the device to be attached to a supporting member such as rope or the like by folding one of said connector panels over into connecting contact with the other of said connector panels about such a supporting member.

17 Claims, 1 Drawing Sheet

FIG. 1
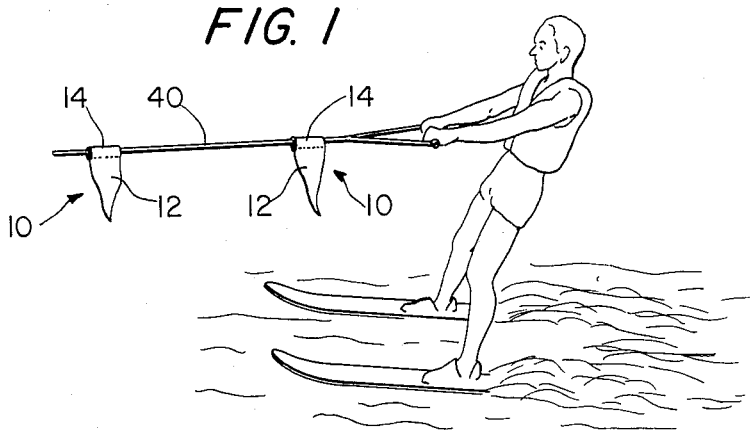
FIG. 4
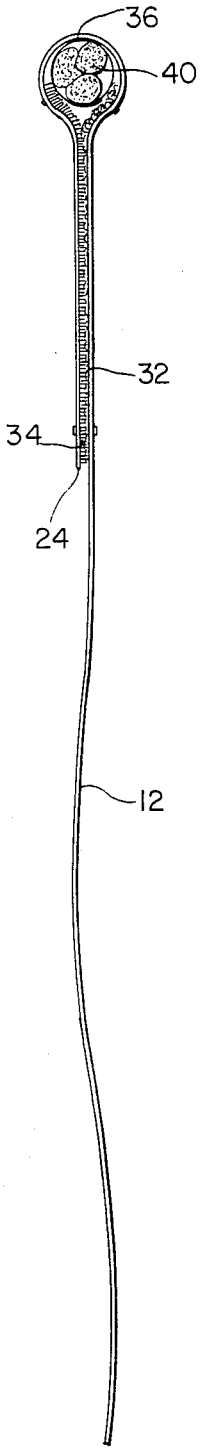
FIG. 2
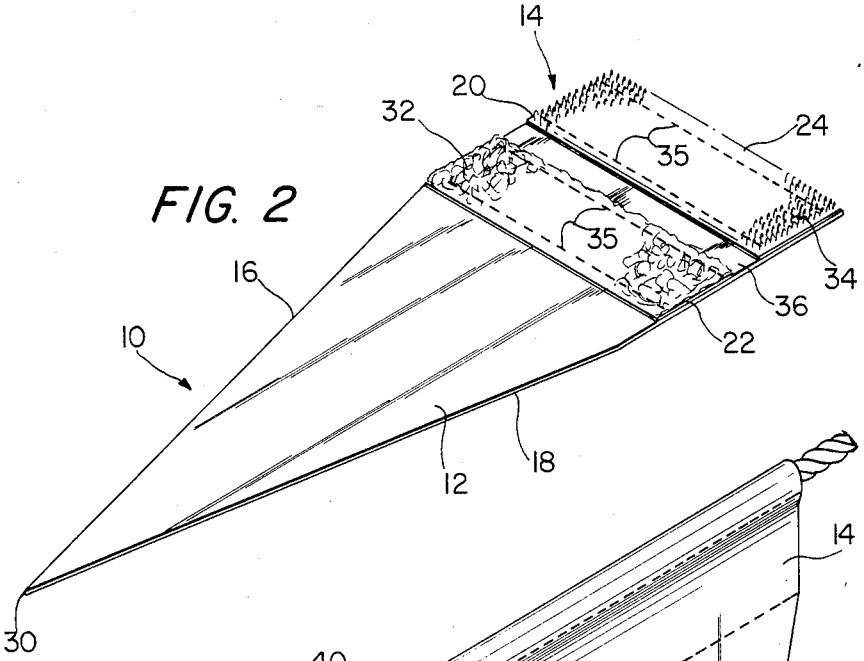
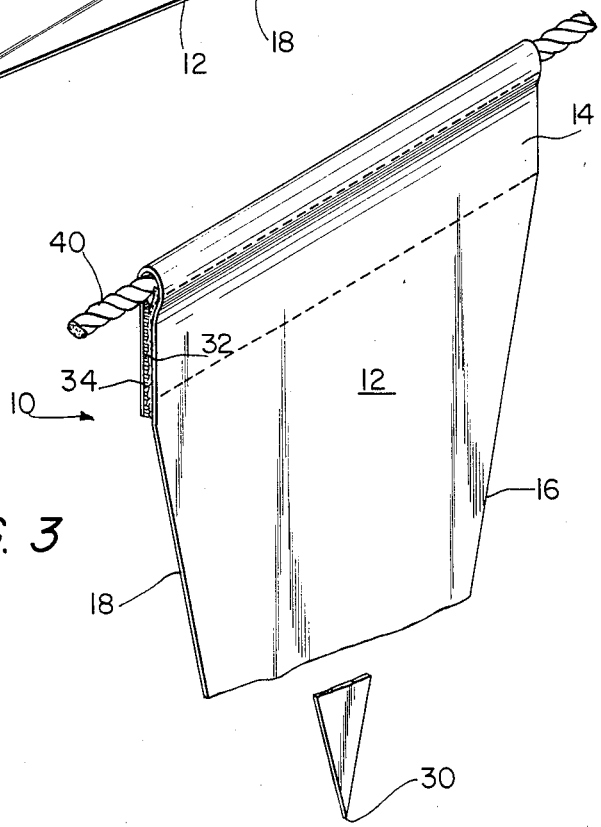
FIG. 3

WARNING PENNANT

BACKGROUND OF THE INVENTION

The present invention is in the field of safety equipment and is more specifically directed to the field of warning pennants and the like usable for providing a visual indication of hazardous conditions. Even more specifically, the present invention is directed to a unique warning pennant which can be easily connected to a tow rope or the like so as to make the position of the rope readily apparent to those in the vicinity. The invention is also capable of being employed to the field of decorative pennants, banners, flags and the like.

A substantial safety hazard is presented when a boat tows another boat, barge or other object such as a water skier since the tow rope will frequently blend in to the background so as to be practically invisible. Consequently, there have been many unfortunate accidents in which other boats have failed to observe the presence of the tow rope and have collided with same with disastrous and frequently fatal results. Therefore, it is a primary object of the present invention to provide a new and improved means for attaching a warning pennant or the like to items such as tow ropes so as to make the supporting item more visible to those in the vicinity. Additionally, it is a further object of the present invention to provide for easily used means for attaching a pennant, flag or the like to any elongated supporting medium such as a cord, rope or flag post or the like for decorative or other similar purposes. While prior known devices such as those shown in U.S. Pat. Nos. 2,688,303; 2,888,900; 3,237,592; 3,910,226 and 3,926,139 have been proposed for providing means for attaching pennants or the like to a supporting member, they have suffered from a number of short comings and deficiencies such as being difficult to attach and/or remove from a supporting member, being complicated and expensive to construct and being usable with only one type and size of supporting member.

SUMMARY OF THE INVENTION

The present invention overcomes the shortcomings of the prior art in providing a pennant or the like that can be easily mounted on a flexible member such as a rope, cord, cable or the like and which can also be mounted on a rigid member such as a flag staff or similar member. Additionally, the preferred embodiment of the invention is capable of being mounted on a variety of different sizes of supporting members without any need for adjustment or other time-consuming manipulation.

More specifically, the preferred embodiment of the invention comprises a pennant formed of a unitary flexible sheet of plastic, cloth or the like consisting of a triangular banner portion which is symmetrical about a longitudinal axis passing through an outer apex and a base or connecting end which is of square configuration and is dimensioned to be folded over a supporting rope, cord, cable, staff or the like. Attachment means in the form of first and second strips of connector fabric extending transverse to the longitudinal axis of the device are attached to the attachment end of the web member with one of the strips comprising a hook strip and the other comprising a pile strip which when pressed together interlock and remain in connected position. Such connecting strips are sold under the trademark VELCRO and are well known to those of skill in the art. The construction permits the preferred embodiment to be attached to a variety of different sizes of supporting members since the hook and pile strip connectors are of sufficient length and width to provide the flexibility of connection necessary for mounting on a variety of different sizes of items.

A better understanding of the invention will be achieved when the following detailed description of the preferred embodiment of the invention is considered in conjunction with the appended drawings in which like reference numerals are used for the same parts as illustrated in the different figures of the drawings.

BRIEF DESCRIPTION OF THE DRAWINGS

FIG. 1 is a perspective view of the preferred embodiment of the invention attached to a tow rope for a water skier illustrating a typical manner of usage of the preferred embodiment;

FIG. 2 is a perspective view of the preferred embodiment illustrating it in its unconnected condition prior to attachment to an elongated supporting member;

FIG. 3 is a perspective view illustrating the preferred embodiment in its attached condition in which it is mounted on a supporting tow-rope or the like; and FIG. 4 is a side elevation view of the preferred embodiment of FIG. 3 looking in the direction of the axis of the supporting member.

DESCRIPTION OF THE PREFERRED EMBODIMENT

The preferred embodiment of the invention, which is generally designated 10, comprises a unitary pennant-like flag or banner preferably of a bright color and consisting of a triangular banner portion 12 extending outwardly from an approximately square attachment end portion 14. The banner portion 12 is defined by side edges 16 and 18 and the attachment in portion 14 is defined by side edges 20 and 22 and a base edge 24. It will be observed that the side edges 16 and 18 intersect to define an apex 30 positioned on the longitudinal axis of the preferred embodiment. Additionally, a first panel 32 of hook-type Velcro brand connector material extends transversely across the generally square attachment end portion 14 and a second or pile panel 34 of Velcro brand connector material is provided transversely across the attachment end portion as best shown in FIG. 2. A clear space 36 is provided between the panels 32 and 34 so that the panel 34 can be easily moved into contacting and attaching condition with the panel 32. Panels 32 and 34 are held in position by stitching 35.

The preferred embodiment is shown mounted in a typical manner such as on a tow rope 40 as shown in FIGS. 1, 3 and 4. It will be apparent that the preferred embodiment could be mounted on either a substantially smaller or substantially larger tow rope or could similarly be mounted on a supporting staff or the like without any undue difficulty. While the preferred material for formation of the preferred embodiment is plastic sheeting, which can either be thread reinforced or unreinforced, it should be understood that other materials such as cloth, paper and the like could also be employed. It should be further understood that the invention is not limited to the preferred embodiment since the spirit and scope of the invention is to be limited solely by the appended claims and those of skill in the art will undoubtedly conceive of many obvious variations which will fall within the coverage of the following claims.

I claim:

1. An elongated pennant-like device comprising a unitary banner portion having first and second oppositely disposed sides and a base portion and having a longitudinal axis, a connector pile panel means mounted on one area of the first side of the base portion and a connector hook panel means mounted on another area of the first side of the base portion and close to but in spaced relation to the pile panel means for permitting said pennant-like device to be attached to a supporting means by folding one of said connector panel means over into connecting contact with the other of said connector panel means about said supporting means, wherein said connector panel means are spaced apart to define an open space therebetween about which said base portion is folded to connect said pile panel means to said hook panel means, and wherein said pile panel means and said hook panel means extend transversely across the width of said base portion.

2. The invention of claim 1 wherein said banner portion comprises a triangular pennant having first and second side edges intersecting at an apex position generally on the longitudinal axis of said pennant-like device.

3. The invention of claim 1 wherein said base portion is of generally square configuration.

4. The invention of claim 1 wherein said banner portion comprises a triangular pennant having first and second side edges intersecting at an apex position generally on the longitudinal axis of said pennant-like device, and said base portion is of generally square configuration.

5. The invention of claim 1 wherein said pile panel means and said hook panel means comprise elongated rectangular panels having their longest dimension approximately perpendicular to said longitudinal axis.

6. The invention of claim 5 wherein said banner portion comprises a triangular pennant having first and second side edges intersecting at an apex position generally on the longitudinal axis of said pennant-like device, said base portion is of generally square configuration, and said connector panels are spaced apart to define an open space therebetween about which said base portion can be folded to connect said panel means.

7. The invention of claim 6 wherein said banner portion comprises a triangular pennant having first and second side edges intersecting at an apex position generally on the longitudinal axis of said.

8. The invention of claim 5 wherein said banner portion comprises a triangular pennant having first and second side edges intersecting at an apex position generally on the longitudinal axis of said pennant-like device and said base portion is of generally square configuration.

9. An elongated pennant-like device comprising a unitary banner portion and base portion formed of a thread reinforced sheet, said sheet having first and second oppositely disposed sides, and having a longitudinal axis, a connector pile panel means mounted on one area of the first side of the base portion and a connector hook panel means mounted on another area of the first side of the base portion and close to but in spaced relation to the pile panel means for permitting said pennant-like device to be attached to a supporting means by folding one of said connector panel means over into connecting contact with the other of said connector means about said supporting means, wherein said pile panel means and said hook panel means extend transversely across the width of said base portion.

10. The invention of claim 9 wherein said banner portion comprises a triangular pennant having first and second side edges intersecting an an apex position generally on the longitudinal axis of said pennant-like device.

11. The invention of claim 9 wherein said base portion is of generally square configuration.

12. The invention of claim 9 wherein said connector panel means are spaced apart to define an open space therebetween about which said base portion is folded to connect said hook panel means to said pile panel means.

13. The invention of claim 9 wherein said pile panel means and said hook panel means extend transversely across the width of said base portion.

14. The invention of claim 13 wherein said pile panel means and said hook panel means comprise elongated rectangular panels having their longest dimension approximately perpendicular to said longitudinal axis.

15. The invention of claim 14 wherein said banner portion comprises a triangular pennant having first and second side edges intersecting at an apex position generally on the longitudinal axis of said pennant-like device, said base portion is of generally square configuration, and said connector panels are spaced apart to define an open space therebetween about which said base portion is folded to connect said pile panel means to said hook panel means.

16. The invention of claim 15 wherein said pile panel means and said hook panel means are connected to said base portion by stitching.

17. The invention of claim 14 wherein said banner portion comprises a triangular pennant having first and second side edges intersecting at an apex position generally on the longitudinal axis of said pennant-like device.

* * * * *